US010183799B1

(12) United States Patent
Luchak

(10) Patent No.: US 10,183,799 B1
(45) Date of Patent: Jan. 22, 2019

(54) BEVERAGE CONTAINER INSULATOR

(71) Applicant: Peter W. Luchak, London (CA)

(72) Inventor: Peter W. Luchak, London (CA)

( * ) Notice: Subject to any disclaimer, the term of this patent is extended or adjusted under 35 U.S.C. 154(b) by 0 days.

(21) Appl. No.: 15/975,215

(22) Filed: May 9, 2018

Related U.S. Application Data

(60) Provisional application No. 62/582,087, filed on Nov. 6, 2017.

(51) Int. Cl.
*B65D 81/38* (2006.01)

(52) U.S. Cl.
CPC ..... *B65D 81/3879* (2013.01)

(58) Field of Classification Search
CPC ..... B65D 81/3879; B65D 81/3876; B65D 81/38; B65D 3/22
USPC ..... 220/739, 737, 592.26, 903, 694; 229/403; 40/310, 306; 215/395, 386; 206/459.5
See application file for complete search history.

(56) References Cited

U.S. PATENT DOCUMENTS 1,632,347 A * 6/1927 Pipkin ..... B65D 23/0885 215/394
2,001,679 A * 5/1935 Haughey ..... A62C 37/50 40/306
2,114,498 A * 4/1938 Lindquist ..... G09F 1/04 40/310
3,149,431 A * 9/1964 Blish ..... G09F 3/04 40/310
4,540,611 A * 9/1985 Henderson ..... B65D 23/08 150/901
5,857,615 A * 1/1999 Rose ..... A47G 23/0216 220/737
6,158,612 A * 12/2000 Alpert ..... A47G 23/0216 220/662
6,814,253 B2 * 11/2004 Wong ..... A47G 23/0216 220/739
7,384,425 B2 * 6/2008 McEwen ..... A61B 17/132 600/495
2003/0217489 A1 * 11/2003 Witkowski ..... B44C 1/175 40/306
2011/0192750 A1 * 8/2011 Kokin ..... B65D 1/265 206/459.1
2012/0243808 A1 9/2012 de Lesseux et al.
2017/0369227 A1 * 12/2017 Metzger ..... B65D 81/3886

* cited by examiner

*Primary Examiner* — Robert J Hicks

(57) ABSTRACT

A beverage container insulator can include a body defining a cylinder with an opening at a first end and a web closing a second end. An interior surface defined by the body can receive a beverage container. An exterior surface is defined by the body opposite to the interior surface. The beverage container insulator can also include a first pattern of indicia positioned on the exterior surface. The first pattern forms readable text oriented such that a bottom edge of the readable text positioned closer to the web than the opening. The beverage container insulator can also include a second pattern of indicia positioned on the interior surface. The second pattern forms readable text oriented such that a bottom edge of the readable text is positioned closer to the opening than the web.

3 Claims, 3 Drawing Sheets

BEVERAGE CONTAINER INSULATOR

CROSS-REFERENCE TO RELATED APPLICATIONS

This application claims the benefit of U.S. Provisional Patent Application Ser. No. 62/582,087 for a FOLD DOWN BEVERAGE INSULATOR SYSTEM, filed on Nov. 6, 2017, which is hereby incorporated by reference in its entirety.

BACKGROUND

1. Field

The present disclosure relates to insulating sleeves or jackets for cans, bottles, barrels, etc, as found in B65D 81/3876 of the Cooperative Patent Classification system.

2. Description of Related Prior Art

U.S. Pub. No. 2012/0243808 discloses INSULATED LINERS AND CONTAINERS. An insulated shipping liner includes a flexible sealed sack having a first layer and second layer sealed together about their outer peripheral edges to form a housing. An insulating layer made from a single sheet of foam material is located within the housing and is configured to be folded such that a first side portion, second side portion and middle portion create a substantially rectangular box form, with the first and second side portions defining opposing sides of the box form, the middle portion defining a bottom of the box form, the substantially rectangular top flap defining at least part of a top of the box form, and the opposing substantially rectangular first and second side flaps defining at least part of other opposing sides of the box form. The box form can be placed in a container to form an insulated container for shipping and/or storage.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A beverage container insulator can include a body defining a cylinder and having an opening at a first end and a web closing a second end opposite the first end. An interior surface can be defined by said body and can be configured to receive a beverage container. An exterior surface can be defined by the body opposite to the interior surface. The beverage container insulator can also include a first pattern of indicia positioned on the exterior surface. The first pattern of indicia forms readable text oriented such that a bottom edge of the readable text is positioned closer to the web than the opening. The beverage container insulator can also include a second pattern of indicia positioned on the interior surface. The second pattern of indicia forms readable text oriented such that a bottom edge of the readable text is positioned closer to the opening than the web.

BRIEF DESCRIPTION OF THE DRAWINGS

The detailed description set forth below references the following drawings.

DETAILED DESCRIPTION

Figure 1:
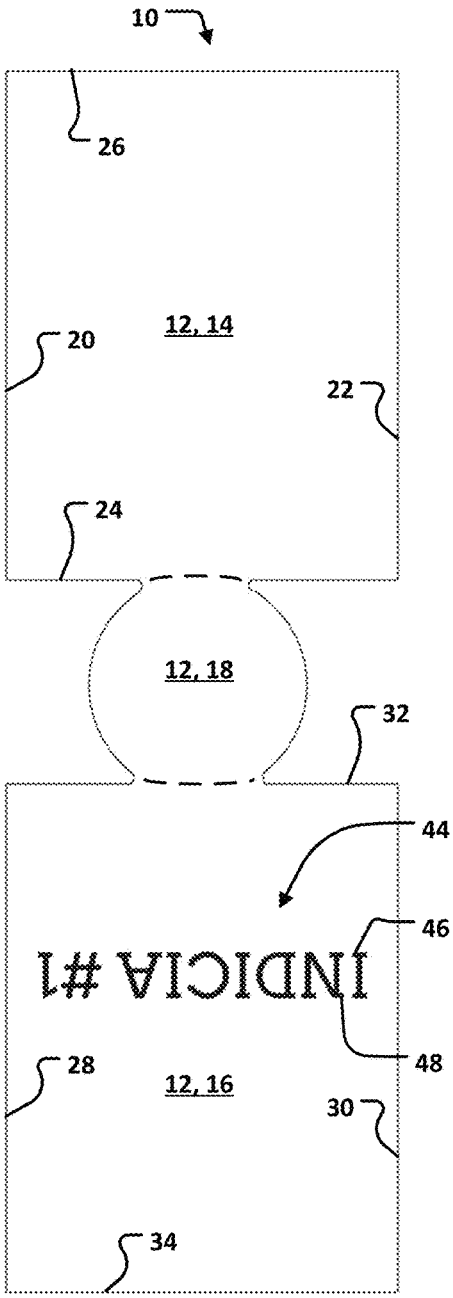
FIG. 1 is a top view of a blank that can be used to form an exemplary embodiment of the present disclosure.

The present disclosure provides a beverage container insulator that substantially departs conventional concepts and designs. The present disclosure provides an article of manufacture configured to receive a beverage container and thermally insulate the beverage container. But further, the present disclosure provides an article of manufacture bearing a first set of indicia on an outside surface and a second set of indicia on an inside surface. The first set of indicia can convey a first message and the second set of indicia can convey a second message. The present disclosure provides an article of manufacture that can insulate a beverage container in a safe, convenient, and economical manner.

In view of the disadvantages inherent in the known types of beverage insulators of known designs and configurations now present in the prior art, the present disclosure provides an improved beverage container insulator. As such, the general purpose of the present disclosure, which will be described subsequently in greater detail, is to provide a new and improved beverage container insulator which has all the advantages of the prior art and none of the disadvantages. In this respect, before explaining at least one embodiment of the present disclosure in detail, it is to be understood that the present disclosure is not limited in its application to the details of construction and to the arrangements of the exemplary embodiment set forth in the following description or illustrated in the drawings. Other embodiments of the present disclosure are capable of being practiced and carried out in various ways. Also, it is to be understood that the phraseology and terminology employed herein are for the purpose of descriptions and should not be regarded as limiting.

With reference now to the drawings, an embodiment of the present disclosure is defined by beverage container insulator 10. The exemplary beverage container insulator 10 includes a blank 12 of material. The exemplary blank 12 can be formed from neoprene. The blank 12 can be formed from other materials in other embodiments, such from a woven fabric, open cell foam, paper, rubber or silicone. An elastomeric material is a polymer with both viscosity and elasticity and relatively weak inter-molecular forces, generally having low Young's modulus and high failure strain compared with other materials. An elastomeric material displays rubber-like elasticity. Alternatively, the blank 12 can be formed from a combination of materials, including a layer of elastomeric material and a layer of fabric.

The exemplary blank 12 includes a first panel portion 14, a second panel portion 16, and a web 18 interconnecting the panel portions 14, 16. The first panel portion 14 extends between opposite edges 20, 22 and also between opposite edges 24, 26. The second panel portion 16 extends between opposite edges 28, 30 and also between opposite edges 32, 34. The web 18 extends between opposite edges 24 and 32. The web 18 is interconnected to the panel portion 14 along the edge 24. The web 18 is interconnected to the panel portion 16 along the edge 32.

Figure 4:
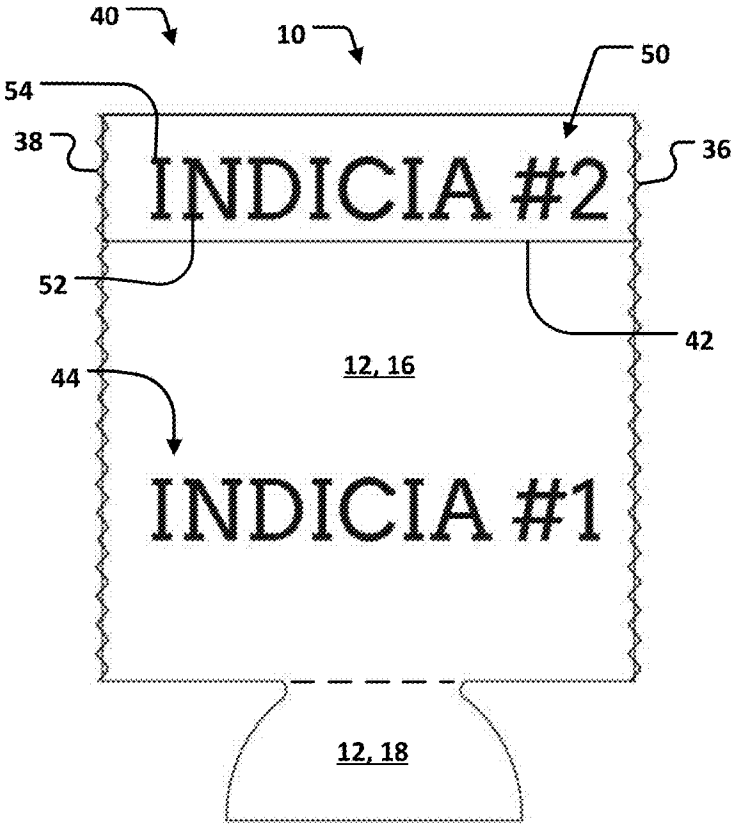
FIG. 4 is a front view of the beverage container insulator formed from the blank shown in FIGS. 1 and 2 wherein the beverage container insulator is arranged in a second configuration.
Figure 3:
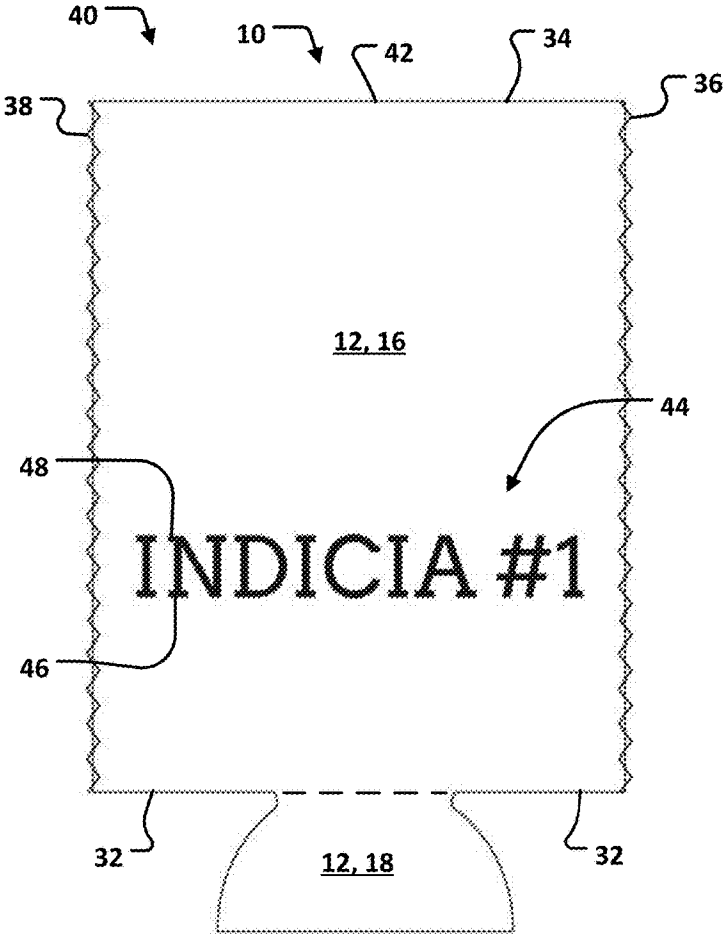
FIG. 3 is a front view of a beverage container insulator formed from the blank shown in FIGS. 1 and 2 wherein the beverage container insulator is arranged in a first configuration.

FIGS. 3 and 4 show the blank 12 further processed to form a generally cylindrical shape. The exemplary edges 20 and 28 have been fixed together with stitching 36. The exemplary edges 22 and 30 have been fixed together with stitching 38. In FIGS. 3 and 4, the beverage container insulator 10 has flattened so that one-half of the web 18 is visible. In operation, the web 18 would be flat and define a partially-closed bottom of the cylinder defined by the stitched-together panel portions 14, 16. Fold lines are represented by dashed lines in the Figures. It is noted that the stitching has been omitted in FIGS. 5 and 6 to enhance the clarity of the other structures.

Figure 2:
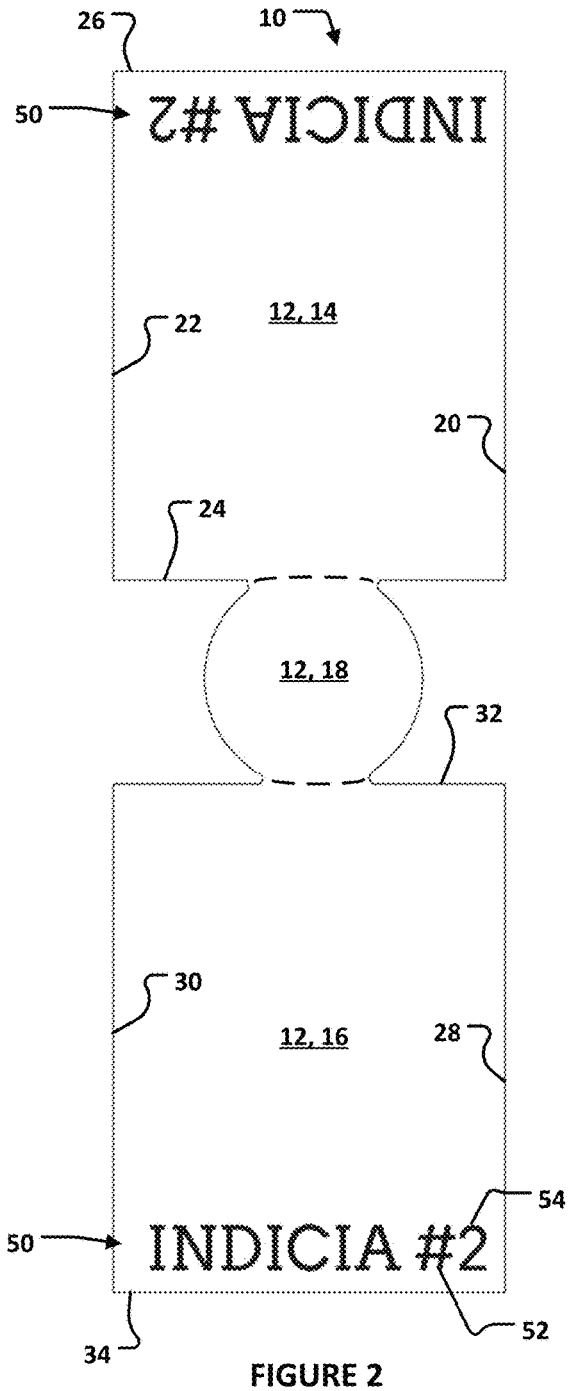
FIG. 2 is a bottom view of the blank shown in FIG. 1.

The panel portions 14, 16 and web 18 thus form a body 40 of the beverage container insulator 10. The exemplary body 40 is generally cylindrical, but could be shaped differently in other embodiments of the present disclosure. The surfaces visible in FIG. 2 shows interior surfaces of the generally-cylindrical body 40. The interior surfaces defined by the body 40 receive and contact the beverage container when the beverage container insulator 10 is in use. FIG. 1 shows exterior surfaces of the generally-cylindrical body 40. The exterior surfaces are opposite of the interior surfaces relative to the body 40.

The edges 26 and 34 cooperate to define an opening 42 of the interior of the generally-cylindrical body 40. A beverage container can be received into the body 40 through the opening 42. The web 18 defines a closed end of the interior of the generally-cylindrical body 40. A beverage container can rest on the web 18 after being received through the opening 42, while encircled by the panel portions 14, 16.

The beverage container insulator 10 also includes a first pattern 44 of indicia. The first pattern 44 of indicia is positioned on the exterior surface of body. The first pattern 44 of indicia forms readable text oriented such that a bottom edge 46 of the readable text is positioned closer to the web 18 than the opening 42. A top edge 48 of the exemplary readable text of the first pattern 44 of indicia is positioned closer to the web 18 than the opening 42. It is noted that multiple patterns of indicia can be positioned on the surface visible in FIG. 1.

The beverage container insulator 10 also includes a second pattern 50 of indicia positioned on the interior surface. The second pattern 50 of indicia forms readable text oriented such that a bottom edge 52 of the readable text is positioned closer to the opening 42 than the web 18. A top edge 54 of the readable text of the second pattern 50 of indicia is positioned closer to the opening 42 than the web 18.

Figure 5:
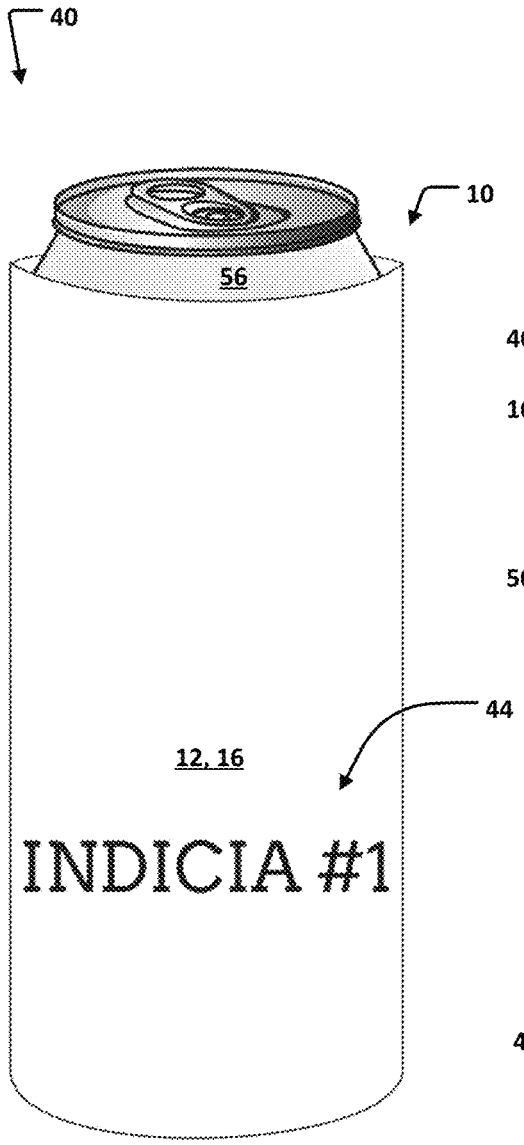
FIG. 5 is a perspective view of the beverage container insulator mounted on a beverage container and arranged in the first configuration (unfolded)

As shown in FIG. 5, in operation, a beverage container insulator 10 can receive a beverage container 56 through the opening 42. The beverage container 56 can rest on the web 18 and be encircled by the panels 14, 16. The first pattern 44 of indicia forms readable text on the exterior surface of the body 40.

Figure 6:
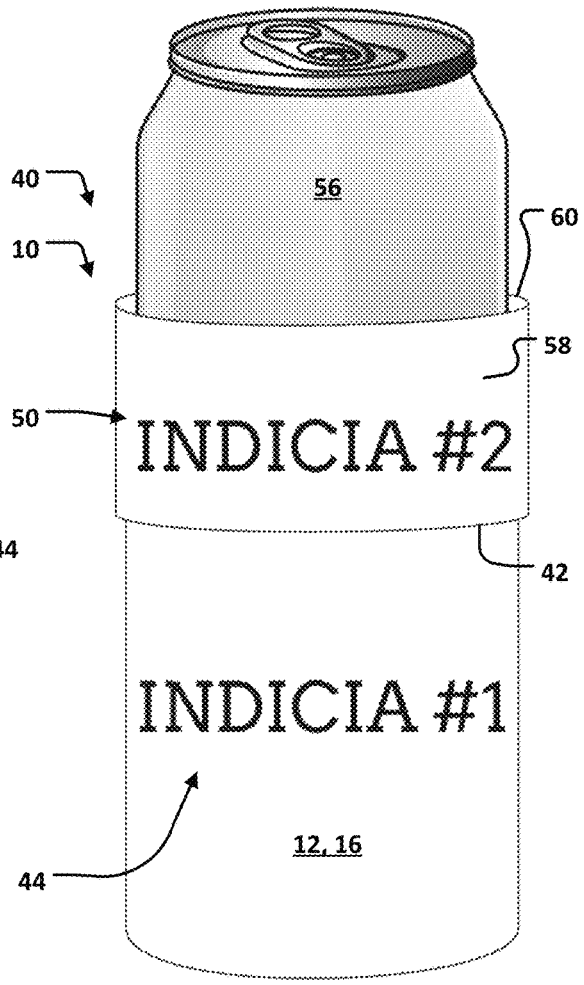
FIG. 6 is a perspective view of the beverage container insulator mounted on the beverage container and arranged in the second configuration (folded).

As shown in FIG. 6, in operation, the top end of the body 40 can then be folded over, or cuffed. A cuffed or folded-over portion of the body 40 is referenced at 58. The second pattern 50 of indicia forms readable text that is exposed on the cuffed portion 58 of the body 40. Both of the exemplary first and second panel portions 14, 16 are configured to fold-over whereby both of the first and second patterns 44, 50 of indicia can be concurrently exposed and concurrently readable.

The beverage container insulator 10 does not merely serve as a support for the first and second patterns 44, 50 of indicia. The respective, readable text defined by the first and second patterns 44, 50 of indicia are directed towards conveying a message or meaning to a human reader relevant to the beverage container. In one embodiment, the readable text of the first pattern 44 of indicia and the readable text of the second pattern 50 of indicia can convey different kinds of drinks. For example, the readable text of the first pattern 44 of indicia can display "SODA" or "COFFEE" and the readable text of the second pattern 50 of indicia can display "DIET" or "DECAF." In this way, a common beverage container insulator 10 can be utilized to insulate different kinds of beverages and advise the user of the particular beverage being insulated. The user will see "SODA" if the beverage is soda and the beverage container insulator 10 is not folded-over. Another user preferring diet soda can select a beverage being insulated by the beverage container insulator 10 when folded over so that the words "DIET" and "SODA" are visible.

In another example, the cuffed portion 58 could extend sufficiently long to cover the first pattern 44 of indicia. The readable text of the first pattern 44 of indicia can display "COLA" and the readable text of the second pattern 50 of indicia can display "ROOT BEER." The person loading the beverage container 56 in the beverage container insulator 10 can fold the opening over as necessary, based on the contents of the beverage container. Again, a single beverage container insulator 10 can be utilized for different kinds of beverages.

In yet another example demonstrating a functional relationship, in one or more embodiments of the present disclosure, the readable text of the first pattern 44 of indicia can convey a kind of beverage and the readable text of the second pattern 50 of indicia can convey nutritional information about the beverage. Further, the second pattern 50 of indicia can include horizontal lines that can be aligned with the level of the beverage in the container. For example, user can fold the body 40 over until a top edge 60 (see FIG. 6) of the cuffed portion 58 is aligned with the level of the beverage in the beverage container. The second pattern 50 of indicia can be arranged so that when this occurs that readable text informs the user of the quantity of the beverage consumed, the quantity of the beverage remaining, and/or the nutritional attributes of either quantity.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein as other present disclosures in other patent documents is hereby unconditionally reserved.

What is claimed is:

1. A beverage container insulator comprising:

a body defining a cylinder and having an opening at a first end and a web closing a second end opposite said first end;

an interior surface defined by said body and configured to receive a beverage container;

an exterior surface defined by said body opposite to said interior surface;

a first pattern of indicia positioned on said exterior surface, said first pattern of indicia forming readable text oriented such that a bottom edge of said readable text is positioned closer to said web than said opening;

a second pattern of indicia positioned on said interior surface, said second pattern of indicia forming readable text oriented such that a bottom edge of said readable text is positioned closer to said opening than said web;

first and second panel portions of the body configured to fold over whereby both of said first and second patterns of indicia are concurrently exposed and concurrently readable; and said first and second patterns of indicia cooperate with one another to convey a message when said first and second panel portions are folded over.

2. The beverage container insulator of claim 1 wherein a top edge of said readable text of said first pattern of indicia is positioned closer to said web than said opening.

3. The beverage container insulator of claim 2 wherein a top edge of said readable text of said second pattern of indicia is positioned closer to said opening than said web.

* * * * *